US005516256A

United States Patent [19]

Ellis

[11] Patent Number: 5,516,256

[45] Date of Patent: May 14, 1996

[54] VERTICAL ACCUMULATOR/STACKER

[76] Inventor: Robert A. Ellis, 1745 Helix Ct., Concord, Calif. 94518

[21] Appl. No.: 966,746

[22] Filed: Oct. 26, 1992

[51] Int. Cl.[6] ..... B65H 39/00

[52] U.S. Cl. ..... 414/757; 270/39

[58] Field of Search ..... 414/789, 795, 414/797.2, 788.4, 757; 270/39

[56] References Cited

U.S. PATENT DOCUMENTS

| | | | |
|---|---|---|---|
| 2,495,994 | 1/1950 | Ward et al. | 270/79 |
| 2,506,004 | 5/1950 | Ward et al. | 270/39 |
| 3,214,162 | 10/1965 | Breidenbach et al. | 270/73 |
| 3,403,792 | 10/1968 | Lape | 414/795.3 |
| 3,415,507 | 12/1968 | Eckert et al. | 270/61 |
| 3,674,254 | 7/1972 | Welch | 270/79 |
| 3,707,063 | 12/1972 | McIntyre | 53/116 |
| 3,784,191 | 1/1974 | Thiel | 271/80 |
| 4,049,259 | 9/1977 | Ventz | 414/788.4 X |
| 4,102,531 | 7/1978 | Jiminez | 270/79 |
| 4,416,653 | 11/1983 | Breski et al. | 493/412 |
| 4,427,404 | 1/1984 | Yamada | 493/414 |
| 4,573,670 | 3/1986 | Felix | 270/39 |
| 4,730,762 | 3/1988 | Felix | 225/4 |
| 4,928,940 | 5/1990 | Dash | 270/1.1 |
| 4,949,608 | 8/1990 | Ward et al. | 83/96 |
| 5,039,083 | 8/1991 | Senn | 271/182 |

OTHER PUBLICATIONS

Photograph of a Wallace Computer Services, Inc. prototype accumulator.

*Primary Examiner*—William E. Terrell
*Assistant Examiner*—Janice L. Krizek

[57] ABSTRACT

An accumulator for business forms is easily inserted into, or removed from, a path of continuous format, zig-zag business forms being fed from one business form handling machine (such as a folder) to another (such as a mailing machine like an inserter). A barrier having drive belts on one face is movable from a position allowing forms to pass under it, to a barrier position in which the forms engage the barrier and are slowly driven up the barrier until they bend over by their own weight onto a shelf. The forms are also driven along a shelf into contact with a stop, and a stack of forms is formed on the shelf. By handling the forms in this way the forms are creased along the perforations between the continuous forms (making subsequent separation easier) and prevented from developing a curl.

23 Claims, 5 Drawing Sheets

VERTICAL ACCUMULATOR/STACKER

In the production of business forms, there are many instances when it is desirable to process the forms in continuous format from a roll to a mailing machine, such as a mail inserting machine. In handling the forms in such a manner, it may be desirable to accumulate a quantity of forms so that one machine can be down, or running at a slow speed than another machine in the line, without adverse effects on the form production rate.

One way that it has been suggested that the general objectives according to the invention could be achieved is the utilization of a random loop accumulator, such as shown in U.S. Pat. No. 4,928,940 or 5,104,107. However, in a random loop accumulator, the forms may set in a curl which makes further processing difficult, and additionally it can be difficult to determine (when too many forms have accumulated which could result in a catastrophic shut down of the equipment).

According to the present invention, a business form handling machine, and a method of handling business forms, are provided which allow forms to be processed directly from a roll to mailing equipment, such as from a roll (such as a Moore 8600 roll feed) connected to a Siemens printer, a Moore 8700 folder, and then a mailing machine (such as a Pitney-Bowes mail inserting machine). The stacker/accumulator according to the invention is typically provided between the folder and the inserter. The business forms are handled in such a way that they do not curl, but rather they first move vertically, and then are provided in a stack from which they can be taken. By handling the forms in this way, a crease is provided along the perforation line between continuous forms which makes subsequent bursting easier, and the forms do not develop a curl. The number of forms that have been stacked/accumulated also is easy to determine, and it is a simple matter to control operation of the preceding or following equipment (e.g., folder and inserter) depending upon the buildup of the forms in the stack.

According to one aspect of the present invention, a method of accumulating business forms in continuous format in zig-zag configuration is provided. Each form has a leading edge and a trailing edge, the trailing edge of one form adjacent the leading edge of the next in the continuous zig-zag format (separated by perfs), and the forms travel in a first generally horizontal path. A shelf is utilized which is generally parallel to the first path and vertically spaced from it, as well as a barrier downstream of the shelf in the first path. The method comprises the following steps: (a) Placing the barrier in the first path; and then continuously. (b) Moving a leading edge of a first of the continuous format of forms in the first path into contact with the barrier. (c) Slowly driving the leading edge of the first form up the barrier until it bends over by its own weight into operative association with the shelf. (d) Slowly driving the first form along the shelf in a second generally horizontal path, essentially opposite the first path, to form the top form in a stack of forms on the shelf. And, (e) causing other forms to follow substantially the same path as the first form, to provide additional forms in a zig-zag stack on the shelf underneath the first form.

Step (d) is typically practiced until the first form engages a stop, and there is also preferably the further step of slowly conveying the first form upwardly away from the shelf as step (e) is being practiced. There also is preferably the further step of sensing the height of the zig-zag stack of business forms on the shelf when it reaches a predetermined level; and arresting the feed of forms in the first path, in step (e), in response to the sensing of the predetermined level, and/or the further step of taking forms off the stack of business forms on the shelf.

According to another aspect of the present invention a business form handling machine operatively connected between first and second other business form handling machines, such as between a folder and an inserter, is -provided. The machine according to the invention comprises: A business form conveyance surface extending in a first plane, and relatively stationary. First and second side elements disposed on opposite sides of the conveyance surface. A forms accumulating backstop; and, means for mounting the backstop to the side elements for movement between first and second positive positions, the first position one in which the backstop is generally parallel to the conveyance surface and spaced a substantial distance therefrom so that business forms may be conveyed on the conveyance surface between the conveyance surface and the backstop, and the second position one in which the backstop is generally perpendicular to the conveyance surface so that business forms on the conveyance surface will be conveyed into contact with the backstop. The backstop typically has a first face, and further comprises a plurality of first conveying elements disposed on the first face for conveying business forms engaging the first face away from the conveying surface. Shelf means are also provided as well as means for mounting the shelf means adjacent the backstop and defining a shelf plane generally parallel to the conveying surface and spaced a substantial distance therefrom, but closer to the conveying surface than the most remote portion of the backstop conveying elements when the backstop is in the second position. The mounting means for the shelf means may include the side elements.

There also is preferably provided second conveying elements on the shelf means for conveying business forms along the shelf means away from the backstop, as well as stopping means associated with the shelf means for stopping the movement of the business forms when they reach a predetermined position. Also, third conveying elements may be associated with the stopping means for conveying business forms upwardly from the shelf means. A motor is typically mounted to the side elements, and drive means interconnect the motor and the first, second and third conveying means so that the motor powers the conveying means.

The first, second and third conveying means typically comprise belts having outstanding ribs, which ribs engage a surface of each business form and effect driving thereof, and pulleys receiving the belts. The conveying surface may comprise a generally horizontal table with conveyor belt means associated therewith, and the first other business form handling machine may comprise a folder, with the second machine comprising a mailing machine such as an inserter. Also, there is preferably provided means for sensing when forms have accumulated on the shelf means more than a predetermined amount, and controlling one or both of the first and second other business form handling machines to prevent further buildup of forms on the shelf. A cart may mount the conveying surface and the side elements, and also mount the first other business machine, with an electrical connection extending from the sensing means to the cart and the first other business form handling machine.

It is a primary object of the present invention to provide for the effective accumulation and stacking of business forms, typically in a business form handling system for handling continuous business forms including other equipment, such as a printer, folder, roll takeoff and inserter. This and other objects of the invention will become apparent from an inspection of the detailed description of the invention and from the appended claims.

DETAILED DESCRIPTION OF THE DRAWINGS

Figure 1:
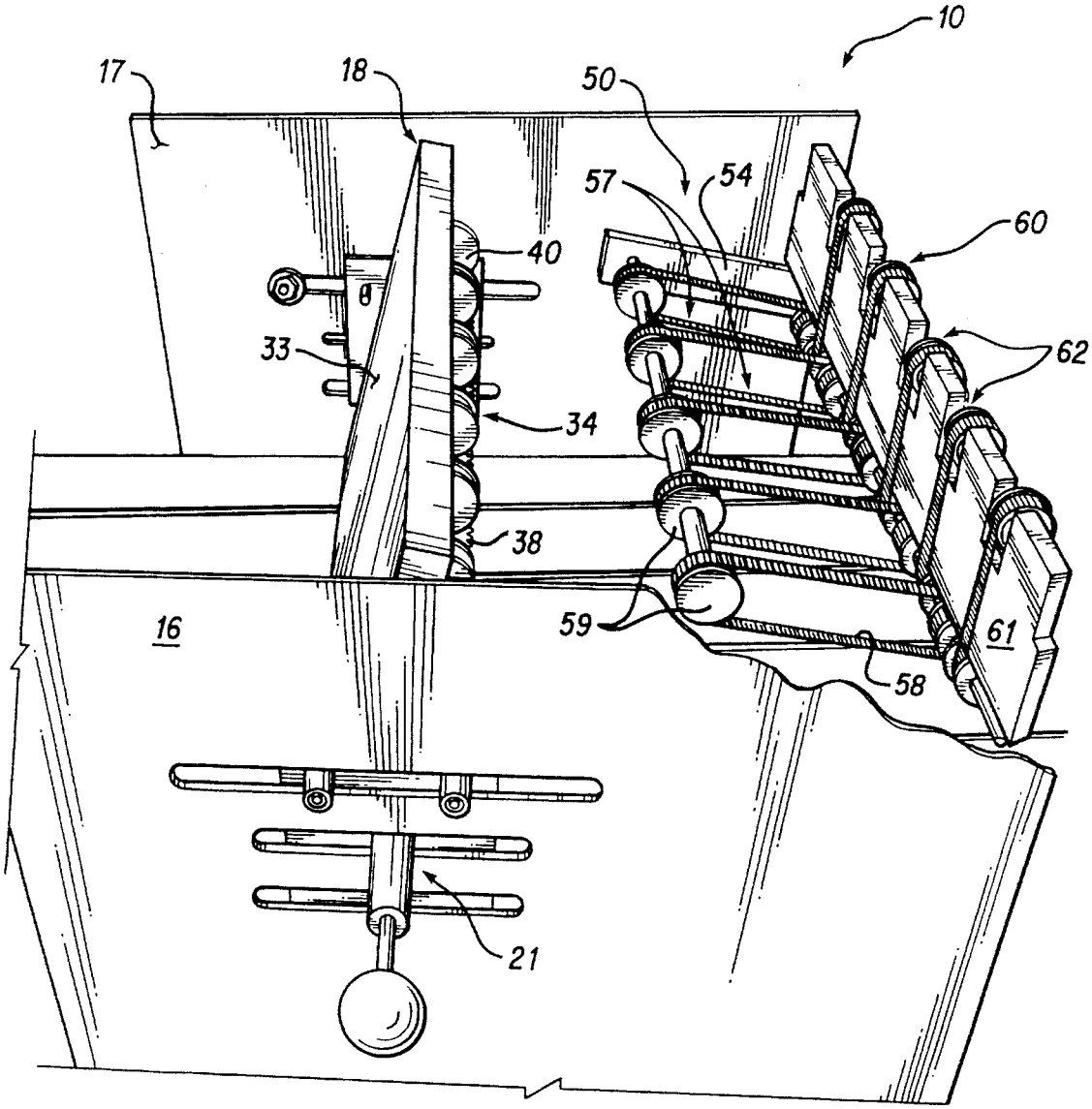
FIG. 1 is a top perspective view, with some portions cut away for clarity of illustration, of an exemplary business form handling machine for accumulating/stacking according to the invention, with a barrier component thereof shown in a barrier-forming position.

The invention relates to a business form handling machine 10 operatively connected between first and second other business form handling machines 11, 12. The machine 11 immediately "upstream" of the machine 10 according to the invention, preferably comprises a folder such as a Moore 8700 folder, while the downstream machine 12 comprises a use device, typically a mailing machine such as a Pitney Bowes inserter. Upstream of the folder 11 there also is typically provided a printer, such as a Siemens printer, and a roll feed, such as a Moore 8600 roll feed. The machine 10 according to the invention is designed to handle up to 18 inch wide forms and 8½ inches by 12 inches in length.

The basic components of the machine 10 comprise a business form conveyance surface 13, such as a table which extends in a first plane and which is relatively stationary. Preferably conveyor belts 14 are provided on the top of the table 13 to convey forms in a first generally horizontal direction 15 away from the folder 11. First and second side elements, such as the sidewalls/plates 16, 17, are disposed on opposite sides of the conveyance surface 13. A forms accumulating backstop, shown generally at 18, is mounted to the side elements 16, 17.

Preferably the backstop 18 is mounted to the side elements 16, 17 by mounting means which provide for movement between first and second positive (that is, locked) positions in which the backstop is fixed. The first position, as shown in FIG. 2, is one in which the backstop 18 is generally parallel to the conveyance surface 13 and spaced a substantial distance therefrom (above it) so that business forms may be conveyed on the conveyance surface 13 between the conveyance surface 13 and the backstop 18 (under the backstop 18). The second position—illustrated in FIG. 1—is one in which the backstop 18 is generally perpendicular to the conveyance surface 13 forming a barrier, so that business forms on the conveyance surface 13 will be conveyed into contact with the backstop 18.

Figure 2:
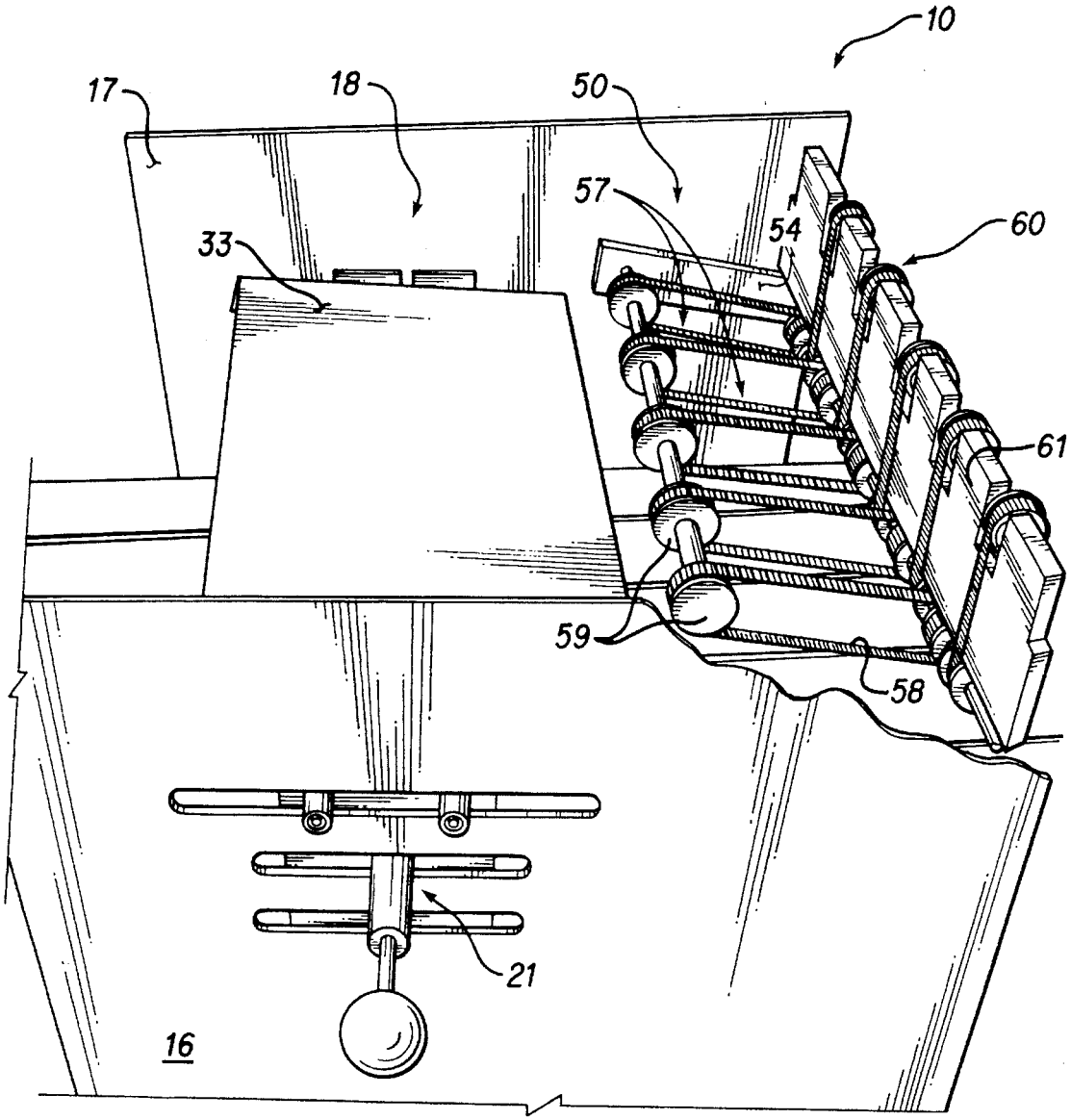
FIG. 2 is a view like that of FIG. 1 only showing the barrier element in a non-barrier position, allowing passage of business forms underneath it.
Figure 3:
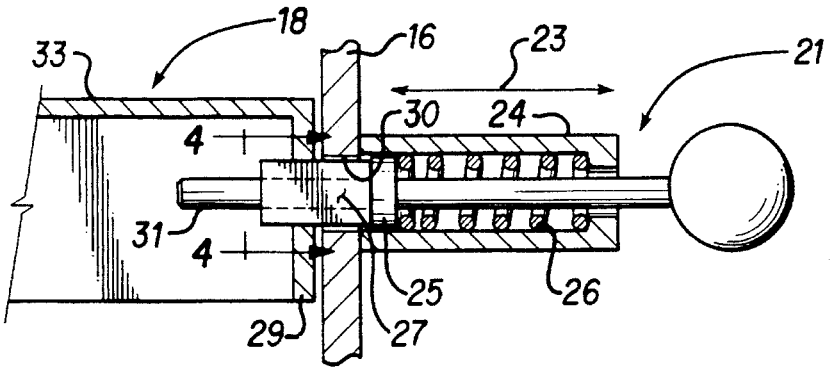
FIG. 3 is a detailed view, partly in cross section and partly in elevation showing a locking mechanism for locking the barrier in either of the positions of FIG. 1 or FIG. 2.
Figure 4:
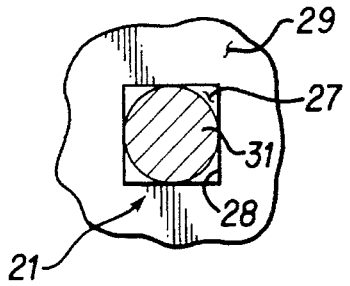
FIG. 4 is a view looking along lines 4—4 of FIG. 3 showing the cooperation between the locking pin and barrier.
Figure 5:
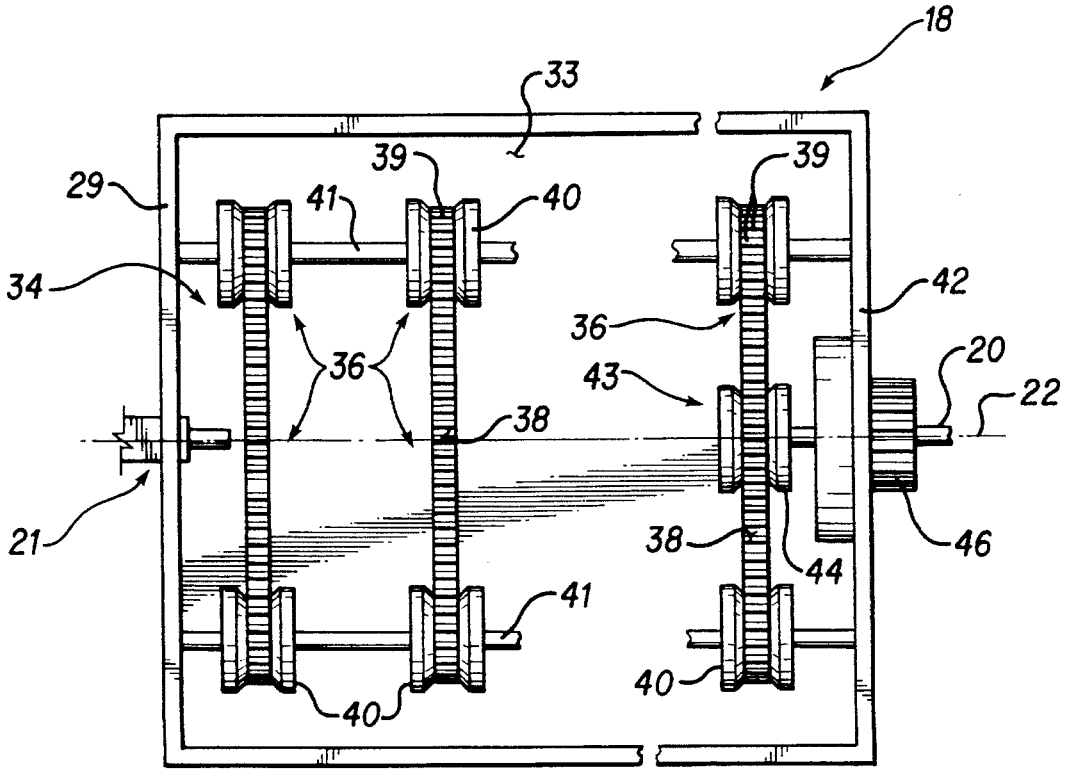
FIG. 5 is a front view of one face of the barrier (the face which points downwardly in the FIG. 2 position)

As seen in FIGS. 3 through 5, the backstop 18 may be mounted for pivotal movement about one shaft element 20 (also seen in FIG. 6) which passes through, and is journalled in, the second side element 17, and a pin 21 (see FIGS. 1, 3, and 4 in particular) which has one position into which it is biased in which the backstop 18 is locked in position (FIG. 3), and a second position which can be moved against the bias, which allows the backstop 18 to be rotated about the axis 22 defined by shaft element 20 and pin 21 between the FIG. 1 and 2 positions. The pin 21 is mounted for reciprocal movement in the direction of the arrows 23 in FIG. 3 by a collar 24 which surrounds the pin 21 and is stationary with respect to the first side element 16. The pin 21 has a shoulder 25 formed on it, with a coil spring 26 acting between the collar 24 and the shoulder 25 to normally bias the pin to the locking position illustrated in FIGS. 1 and 3. In the locking position a rectangular, or other non-round, portion 27 of the pin 21 is received within a similarly shaped opening 28 (see FIG. 4) in the backstop 18 sidewall 29, thereby preventing pivotal movement of the backstop 18. The same pin 21 non-round portion 27 is received in a similar non-round opening 30 in the first side element 16.

When the pin 21 is moved away from the backstop 18 in the direction of the arrows 23 of FIG. 3 against the spring 26 bias, eventually a round portion 31 thereof will come into association with the opening 28 and will allow the backstop 18 to be pivoted between the positions of FIGS. 1 and 2. Once pin 21 is released into the new position into which the barrier 18 has been pivoted, which is 90° from the other position, the pin 21 is released and the spring 26 pressure forces the non-round portion 27 into engagement with the opening 28 in the backstop 18, locking it in place.

Figure 6:
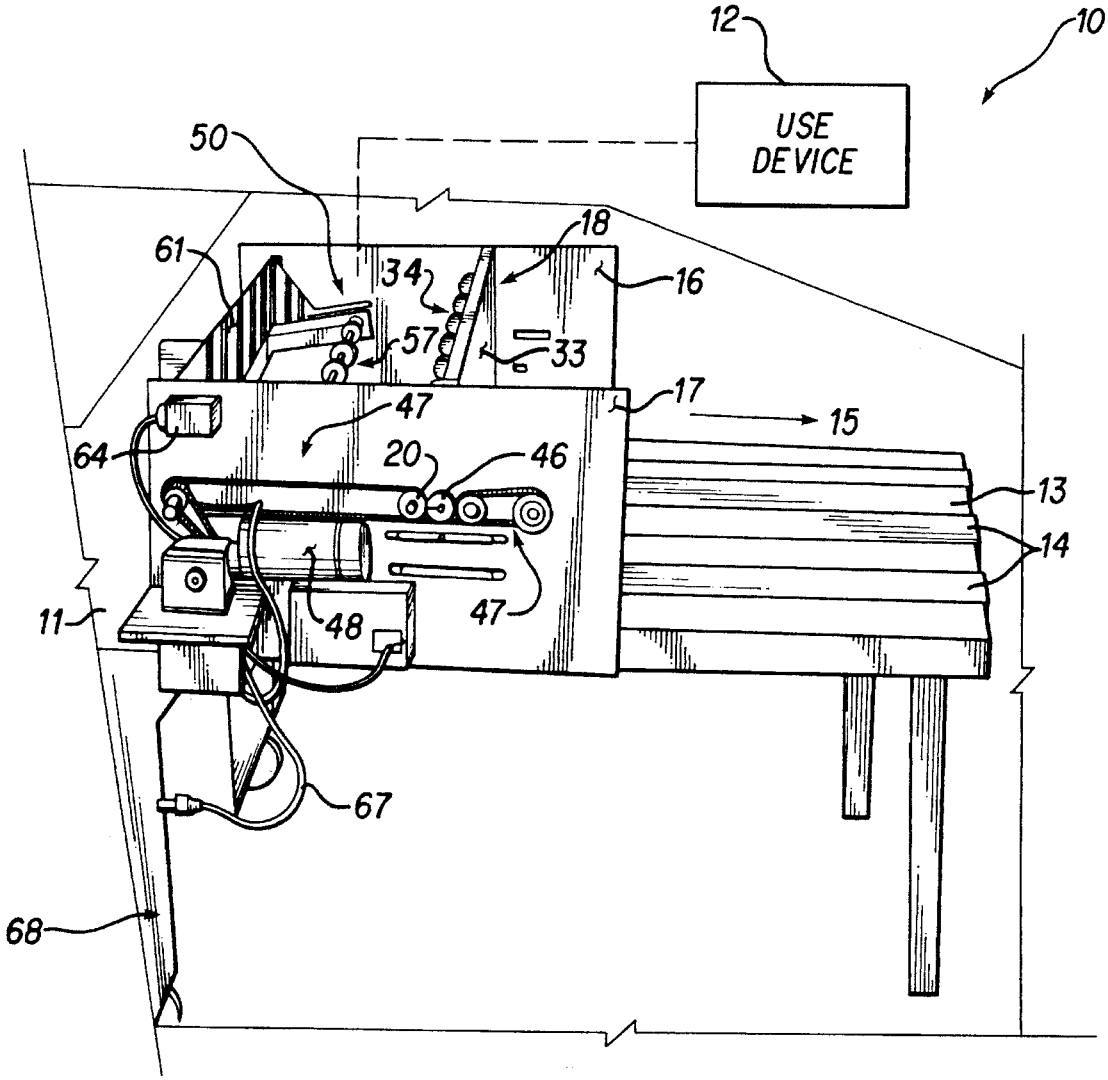
FIG. 6 is a is a top perspective view of the machine of FIGS. 1 through 5 from the opposite side thereof from FIGS. 1 and 2, and showing it in association with a folder mounted on a common cart.
Figure 7:
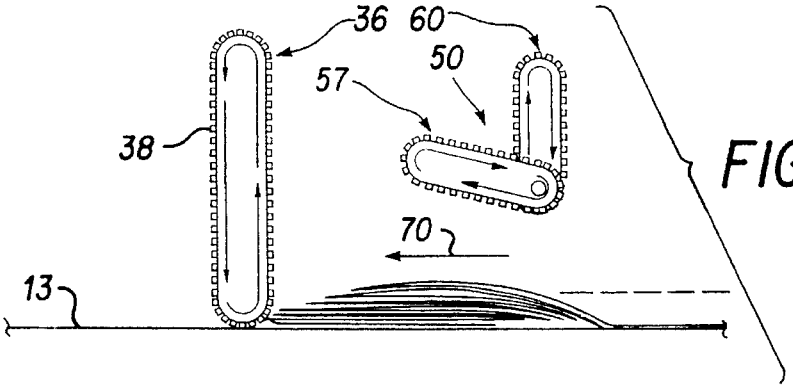
FIGS. 7 through 10 are schematic views, showing only the conveying elements and the folded business forms, which progressively illustrate how forms are accumulated and stacked according to the method of the present invention.
Figure 8:
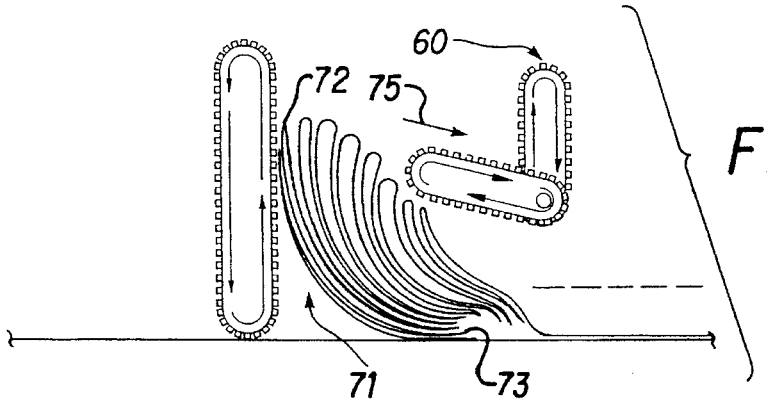

The top face 33 of the backstop 18 as seen in FIG. 2 is flat, however, the opposite face 34—which is the barrier forming face—seen in FIG. 5 has a plurality of first conveying elements 36 disposed on it for conveying business forms which engage the face 34 away from the conveyance surface 15. The conveying elements 36, as illustrated in FIG. 5, preferably comprise a plurality of belts 38, e.g., of rubber, which have outstanding ribs 39 which are designed to engage a surface of the business form and effect driving thereof. The belts 38 are mounted on pulleys 40, which in turn are mounted on shafts 41 (see FIG. 5) extending between the sidewalls 29, 42 of the backstop 18. A drive mechanism 43 for those pulleys 40 and belts 38 is provided by the drive pulley 44 connected to the shaft 20 as seen in FIG. 5, which in turn is connected to a gear 46. As seen in FIG. 6, the gear 46 is connected to drive means 47 to effect driving thereof, the drive means 47 ultimately being connected to the motor 48 which is mounted on the second side element 17. The drive elements 36 are moved very slowly so that the forms only inch upwardly.

Figure 9:
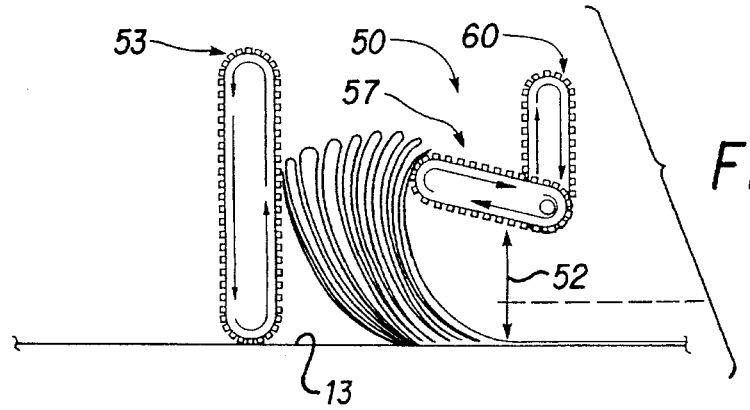

As seen in FIGS. 1, 2, and 6, the machine 10 also comprises shelf means 50 adjacent the backstop 18 and defining a shelf plane generally parallel to the conveyance surface 13 and spaced a substantial distance 52 from it (that is, vertically above—see FIG. 9). However, the shelf means 50 is closer to the conveyance surface 13 than the most remote portion (top portion 53 in FIG. 9) of the backstop conveying elements 36. The shelf means 50 are also preferably mounted by the side plates/elements 16, 17, and by arms 54 mounted to the interior thereof (see FIG. 1 in particular).

The shelf means 50 preferably include second conveying elements 57 for conveying business forms along the shelf means 50 away from the backstop 18. The second conveying elements 57 preferably comprise the ribbed belts 58 mounted on the pulleys 59 and driven by the same drive means 47 as the conveying elements 36 on the backstop 18. The second conveying elements 57 convey the forms until they contact the stop means 60, which may be formed by the plate 61 (FIGS. 1 and 2 in particular) which also preferably has third conveying elements 62 associated therewith. The third conveying elements 62 are like the first and second conveying means 36, 57, and are designed to engage and slowly move business forms upwardly away from the shelf 50 plane. The common drive means 47, driven by the motor 48, drive all of the first, second, and third conveying means, all being driven very slowly.

Figure 10:
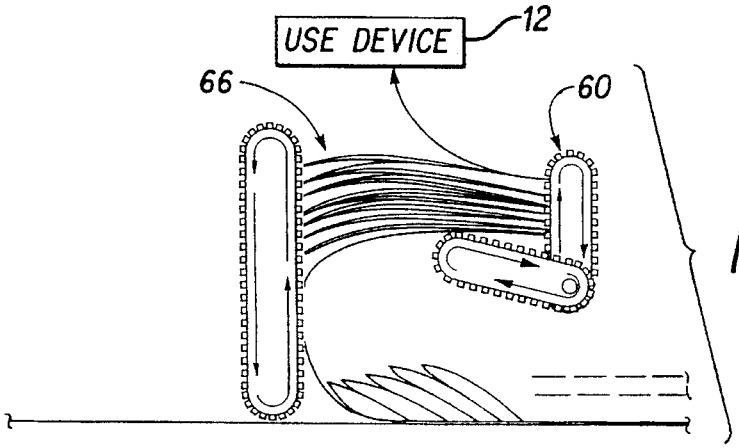

The machine 10 also comprises sensing means for sensing when forms have accumulated on the shelf means more than a predetermined amount. The sensing means are shown only schematically at 64 in FIG. 6, but may comprise photoelectric means, or any other common type of position sensor for business forms. The sensing means 64, which may be adjustable in height from the top of the shelf 50, sense the predetermined height of a stack of forms (66 in FIG. 10) on the shelf 50. When the predetermined stack height is sensed, the sensing means 64 may operate to control one or both of the folder 11 and inserter 12 so as to reduce the height of the stack 66 on the shelf. FIG. 6 shows an electrical connection 67 going from the sensing means 64 (and from the motor 48) to the folder 11, and shows the machine 10 mounted as an extension of the folder 11 on the same cart 68.

The particular manner in which the forms are accumulated and stacked according to the invention, fed from the folder 11 in a first path 70, which is a generally horizontal direction, best seen with respect to FIGS. 7 through 10 which show the continuous progress of representative ones of the forms as they are continuously fed from the folder 11 toward the backstop 18, and then up away from the backstop 18 to stack on the shelf. Note in FIGS. 7 through 10 that the business forms are in continuous format and zig-zag configuration, each form 71 having a leading edge 72 and a trailing edge 73 (FIG. 8), the trailing edge of one form adjacent the leading edge of the next in the continuous zig-zag format (a perforation line being between them). The action on the business forms will be described with respect to a "first form" 71 seen in FIGS. 7 through 10, but the action on the rest of the forms is very similar, the forms stacking up both as they are being conveyed upwardly, and then later on as they bend over under their own weight (FIG. 9) onto the shelf 50 and form the horizontal stack 66 on the shelf 50.

The method according to the invention, which can be seen with respect to FIGS. 7 through 10, comprises the steps of placing the barrier 18 (backstop) in the first path 70 of conveyance of the forms, and then continuously practicing the other steps. The other steps include moving the leading edge 72 of the first 71 of the continuous formatted forms in the first path 70 into contact with the barrier 18, either by the conveying belts 14 on the conveyance table 13, or by the natural action of the folder 11. Then there is the step of slowly driving the leading edge 72 of the first form 71 of the barrier 18 (utilizing the first conveying elements 36, particularly the ribs 39 on the belts) until it bends over by its own weight (see FIG. 9) into operative association with the shelf 50. The forms are slowly driven along the shelf 50 in a second generally horizontal path 75, essentially opposite the first path, and the first form 71 forms the top of a stack 66 of forms on the shelf 50 (see FIG. 10). The forms are continuously fed in this manner to provide additional forms in a zig-zag stack on the shelf 50 underneath the first form 71 (again see FIG. 10). Ultimately, the forms are taken off the stack 66, first form 71 first (that is top form first) to the use device 12, such as a Pitney Bowes mail inserter machine.

Note that as the forms are being conveyed in the second path 75 they engage a stop plate 61, and then are also preferably slowly conveyed upwardly from the shelf 50 along the stop 60 by the third conveying elements 62.

There also is the step of sensing the height of the zig-zag stack on the shelf (FIG. 10) and, when it reaches a predetermined level, arresting the feed of forms in the first path 70 in response to the sensing of the predetermined level, as by shutting down the folder 11. Alternatively, or in addition, the forms may be removed from the stack 66 utilizing the use device 12.

Because the forms are handled in the manner illustrated in FIGS. 7 through 10, first being moved vertically upwardly in a vertical stack (FIG. 8), and then into a horizontal stack (FIG. 10), the forms have a crease formed along the edges thereof (the perforations) which facilitates further handling and bursting. Also, the forms do not set in a curl position, which can happen in a random loop accumulator. Also, the machine 10 according to the present invention includes its own motor 48, and is conveniently mounted on a folder 11 or the like, and when the backstop 18 is moved to the position illustrated in FIG. 2, the forms may be readily conveyed by the conveyor belts 14 on the table 13 directly to another machine 12 downstream of the folder 11, such as a burster or the like.

It will thus be seen that according to the present invention an advantageous method and business form handling machine have been provided. While the invention has been illustrated in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A business form handling machine operatively connected between first and second other business form handling machines, comprising:

a business form conveyance surface extending in a first plane, and relatively stationary;

first and second side elements disposed on opposite sides of said conveyance surface;

a forms accumulating backstop; and means for mounting said backstop to said side elements for movement between first and second positive positions, said first position one in which said backstop is generally parallel to said conveyance surface and spaced a substantial distance therefrom so that business forms may be conveyed on said conveyance surface between said conveyance surface and said backstop, and said second position one in which said backstop is generally perpendicular to said conveyance surface so that business forms on said conveyance surface will be conveyed into contact with said backstop.

2. A business form handling machine as recited in claim 1 wherein said backstop has a first face; and further comprising a plurality of first conveying elements disposed on said first face for conveying business forms engaging said first face away from said conveyance surface.

3. A business form handling machine as recited in claim 2 further comprising shelf means; and means for mounting said shelf means adjacent said backstop defining a shelf plane generally parallel to said conveyance surface and spaced a substantial distance therefrom, but closer to said conveyance surface than the most remote portion of said backstop conveying elements when said backstop is in said second position.

4. A business form handling machine as recited in claim 3 wherein said mounting means for mounting said shelf means includes said side elements.

5. A business form handling machine as recited in claim 3 further comprising second conveying elements on said shelf means for conveying business forms along said shelf means away from said backstop.

6. A business form handling machine as recited in claim 5 further comprising stopping means associated with said shelf means, extending generally parallel to said backstop when said backstop is in said second position, for stopping the movement of business forms conveyed by said second conveying elements away from said backstop.

7. A business form handling machine as recited in claim 6 further comprising third conveying elements associated with said stopping means for conveying business forms upwardly from said shelf means.

8. A business form handling machine as recited in claim 7 further comprising a motor mounted to said side elements, and drive means interconnecting said motor and said first, second, and third conveying means so that said motor powers said conveying means.

9. A business form handling machine as recited in claim 7 wherein said first, second, and third conveying means comprise belts having outstanding ribs, which ribs engage a surface of a business form and effect driving thereof; and pulleys receiving said belts.

10. A business form handling machine as recited in claim 1 wherein said conveyance surface comprises a generally horizontal table, with conveyor belt means associated therewith.

11. A business form handling machine as recited in claim 1 wherein said first other business form handling machine comprises a folder for folding business forms in continuous format, and wherein said second other business form handling machine comprises a machine for acting upon printed business forms in continuous format.

12. A business form handling machine as recited in claim 3 further comprising sensing means for sensing when forms have accumulated on said shelf means more than a predetermined amount.

13. A business form handling machine as recited in claim 12 further comprising control means responsive to said sensing means for controlling one or both of said first and second other business form handling machines to prevent further buildup of forms on said shelf means.

14. A business form handling machine as recited in claim 13 further comprising a cart for mounting said conveyance surface and said side elements, said cart also mounting said first other business machine, and an electrical connection extending from said sensing means to said cart and said first other business form handling machine.

15. A business form handling machine as recited in claim 11 wherein said second business form machine comprises a mailing machine.

16. A business form handling machine as recited in claim 1 further comprising shelf means; and means for mounting said shelf means adjacent said backstop defining a shelf plane generally parallel to said conveyance surface and spaced a substantial distance therefrom.

17. A business form handling machine as recited in claim 16 further comprising second conveying elements on said shelf means for conveying business forms along said shelf means away from said backstop.

18. A business form handling machine operatively connected between first and second other business form machines, comprising:

a business forms conveyance surface extending in a first plane, and relatively stationary;

first and second side elements disposed on opposite sides of said conveyance surface; and a forms accumulating backstop mounted to said side elements and positionable in a position in which said backstop is generally perpendicular to said conveyance surface so that business forms on said conveyance surface will be conveyed into contact with said backstop;

said backstop having a first face; and a plurality of first conveying elements disposed on said first face for conveying business forms engaging said first face away from said conveyance surface.

19. A business form handling machine as recited in claim 18 further comprising shelf means; and means for mounting said shelf means adjacent said backstop defining a shelf plane generally parallel to said conveyance surface and spaced a substantial distance therefrom, but closer to said conveyance surface than the most remote portion of said backstop conveying elements.

20. A business form handling machine as recited in claim 19 wherein said mounting means for mounting said shelf means includes said side elements.

21. A business form handling machine as recited in claim 19 further comprising second conveying elements on said shelf means for conveying business forms along said shelf means away from said backstop.

22. A business form handling machine as recited in claim 21 further comprising stopping means associated with said shelf means for stopping the movement of business forms conveyed by said second conveying elements away from said backstop.

23. A business form handling machine as recited in claim 22 further comprising third conveying elements associated with said stopping means for conveying business forms upwardly from said shelf means.

* * * * *